US005187486A

United States Patent [19]

Kölzer

[11] Patent Number: 5,187,486

[45] Date of Patent: Feb. 16, 1993

[54] METHOD OF AND APPARATUS FOR AUTOMATICALLY CALIBRATING A PHASED-ARRAY ANTENNA

[75] Inventor: Peter Kölzer, Korntal-Müchingen, Fed. Rep. of Germany

[73] Assignee: Standard Elektrik Lorenz Aktiengesellschaft, Stuttgart, Fed. Rep. of Germany

[21] Appl. No.: 684,674

[22] Filed: Apr. 12, 1991

[30] Foreign Application Priority Data

Apr. 14, 1990 [DE] Fed. Rep. of Germany ..... 4012101
May 4, 1990 [DE] Fed. Rep. of Germany ..... 4014320

[51] Int. Cl.[5] ..... H01Q 3/00
[52] U.S. Cl. ..... 342/360; 342/173
[58] Field of Search ..... 342/360, 173, 174

[56] References Cited

U.S. PATENT DOCUMENTS 4,453,164 6/1984 Patton ..... 343/360
4,488,155 12/1984 Wu ..... 343/376
4,520,361 5/1985 Frazita ..... 343/372
4,926,186 5/1990 Kelly, et al. ..... 342/360

OTHER PUBLICATIONS

J. Ronen, "Monitoing Techniques for Phased-Array. . .", IEEE Trans. on Antennas and Propagation, vol. AP-33, No. 12, Dec. 1985, pp.1313-1327.

Rice et al., "Quadrature Sampling With High Dynamic Range", *IEEE Transactions on aerospace and Electronic Systems*, vol. AES-18 No. 4, Nov. 1982, pp. 736-739.

*Primary Examiner*—Theodore M. Blum
*Attorney, Agent, or Firm*—Brunell & May

[57] ABSTRACT

Landing aids using phased-array antennas must be very carefully calibrated. Conventional methods use probes which are inserted into each individual radiating element of the array antenna. For 6-bit phase shifters, this method is not suficiently accurate. A method and an apparatus are disclosed wherein the aperture illumination of the array antenna is determined from the output of an integral waveguide and compared with a desired aperture illumination. The difference between actual value and desired value is compensated for iteratively with the aid of an adaptive control system.

16 Claims, 3 Drawing Sheets

METHOD OF AND APPARATUS FOR AUTOMATICALLY CALIBRATING A PHASED-ARRAY ANTENNA

TECHNICAL FIELD

The present invention relates to a method of and an apparatus for automatically calibrating a phase-array antenna, particularly array antennas for microwave landing systems.

CLAIM FOR PRIORITY

This application is based on and claims priority form German Patent Applications No. 40 12 101.1 dated Apr. 14, 1990 and No. 40 14 320.1 dated May 4, 1990. To the extent such prior applications may contain any additional information that might be of any assistance in the use and understanding of the invention claimed herein, they are hereby incorporated by reference.

BACKGROUND ART

Aircraft landing aids, particularly microwave landing systems, must meet very stringent accuracy requirements. To be able to satisfy these requirements, the antennas used must be very well calibrated. This applies to both azimuth antennas (AZ antennas) and elevation antennas (EL antennas). U.S. Pat. No. 4,502,361 discloses a method of calibrating a phased-array AZ antenna with 4-bit phase resolution wherein probes are inserted into each individual waveguide radiator. It has been found, however, that in phased-array antennas with 6-bit resolution, the reproducibility of the measurements with the aid of probes does not yield satisfactory results. Such an antenna could be better calibrated if its aperture amplitude and phase illumination were known. To derive the aperture illumination of a phased-array antenna, use is made of integral monitor waveguides. Signal components from each radiating element are coupled through coupling holes into an integral monitor waveguide either shortly before or immediately after transmission. The output of the integral monitor waveguide corresponds, to a first degree of approximation, to the far-field pattern of the antenna. The far-field pattern and the antenna aperture illumination are related by a Fourier transform. Therefore, the complex aperture illumination of the antenna can be determined from the output of the integral monitor waveguide. A conventional method of doing this is the quadrature method (I/Q converter). In this method, the signal from a local oscillator is mixed with the output signal from the integral monitor waveguide twice, once at an angle of 0° and a second time with a 90° phase shift. The mixing with a 0° phase shift provides the real part of the output signal of the integral monitor waveguide, and the mixing with a 90° phase shift provides the imaginary part. A subsequent Fourier transformation of the real and imaginary parts of the output signal yields the aperture illumination of the antenna. A disadvantage of this method is the use of two mixers.

It is the object of the invention to provide a method of and an apparatus for calibrating phased-array antennas in a reproducible manner and with an accuracy required to meet safety standards.

DISCLOSURE OF INVENTION

In accordance with the invention, the aperture illumination of the array antenna is determined from the output of an integral waveguide and compared with a desired aperture illumination. The difference between actual value and desired value is compensated for iteratively with the aid of an adaptive control system. Preferably, the real part of the actual signal is obtained by homodyne detection of the signal from the integral monitor waveguide, and the imaginary part is computed from the real part using a Hilbert transform, whereupon the far-field signal may be calculated using a Fourier transform.

One advantage of the method and apparatus according to the invention is that the antenna can also be calibrated during operation. Another advantage is that because of the choice of the Hilbert transform to obtain the aperture illumination, only one mixer is needed. This results in an improvement in the signal-to-noise ratio of the usable signal.

BRIEF DESCRIPTION OF DRAWINGS

An embodiment of the invention will now be explained in greater detail with reference to the accompanying drawings, in which.

BEST MODE FOR CARRYING OUT THE INVENTION

Figure 1:
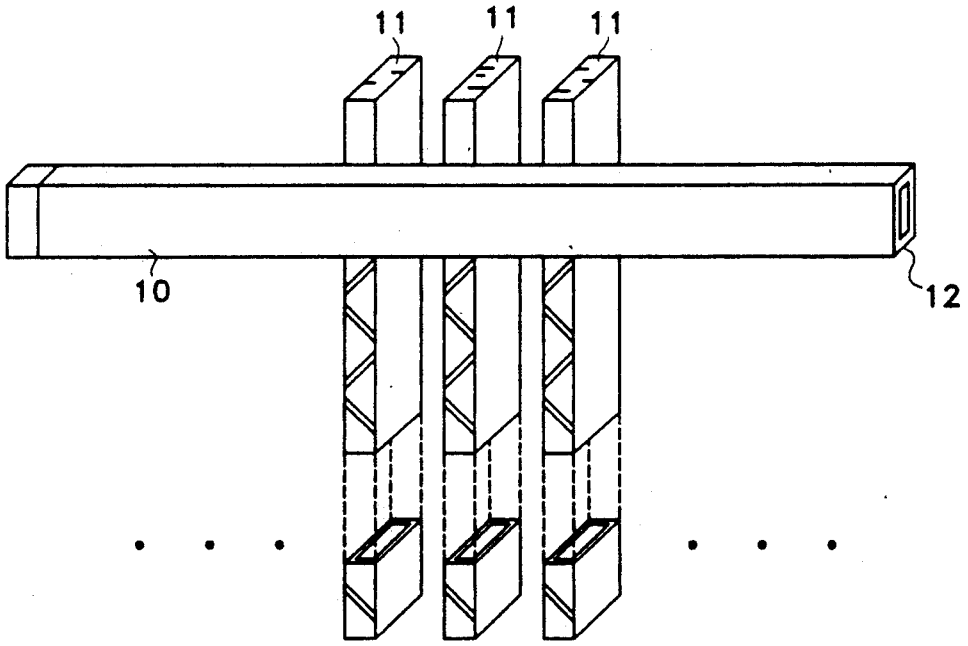
Fig. 1 (PRIOR ART)
FIG. 1 shows the principle of an array antenna with an integral monitor waveguide.

FIG. 1 shows part of a phased-array antenna. The radiating elements of the antenna are designated 11. 10 is an integral monitor waveguide into which signal components from each radiating element are coupled through coupling holes. In the integral monitor waveguide, the signal components combine into a complex, time-varying signal. The signal components coupled into the integral monitor waveguide are components either shortly before transmission (in the case of azimuth antennas) or immediately after transmission (in the case of elevation antennas). The signal appearing at the output 12 of the integral monitor waveguide 10 corresponds, to a first degree of approximation, to the far-field pattern of the antenna. Because of the Fourier-transform relationship between the antenna aperture illimination and the far-field pattern, the complex aperture illumination can be calculated from the output signal of the integral monitor waveguide.

Figure 2:
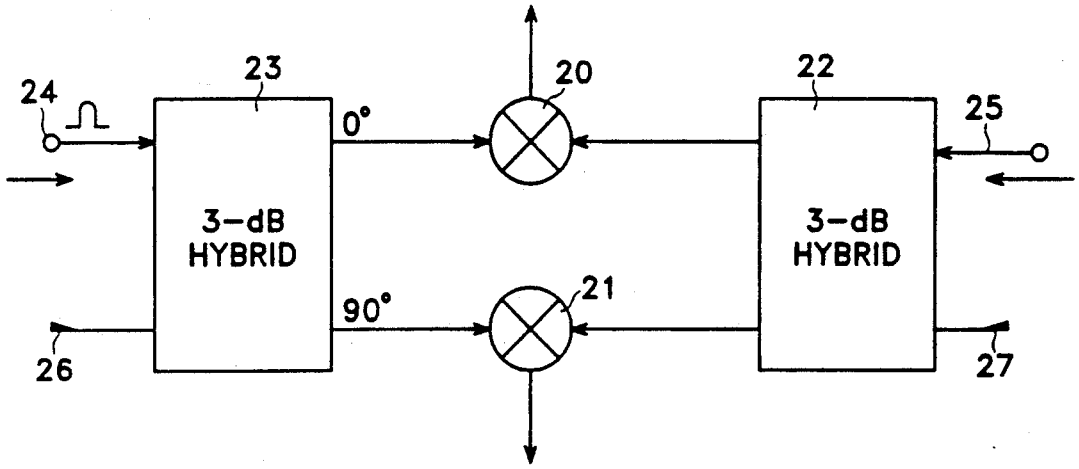
Fig. 2 (PRIOR ART)
FIG. 2 shows and I/Q converter.

To this end, in prior art apparatus, the output of the integral monitor waveguide is conditioned in the manner shown in FIG. 2. Mixers 20 and 21 are supplied with signals from hybrids 22 and 23. The hybrid 22 is, for example, a 3-dB 0° hybrid, and the hybrid 23 a 3-dB 90° hybrid. Via an input 24, the hybrid 23 is supplied with a signal from a local oscillator. Via an input 25, the hybrid 22 is supplied with the output signal from the integral monitor waveguide. 26 and 27 denote RF terminations, also called "RF absorbers". They serve to terminate components for radio frequencies in a non-reflecting manner. The output of the mixer 20 then provides the real part of the signal applied at the input 25, and the output of the mixer 21 provides the imaginary part. The arrangement described is referred to as an "I/Q converter", and the outputs of the two mixers are called "quadrature components". In a further step, the aperture illumination of the antenna is determined via a Fourier transform. The arrangement just described needs two mixers to represent the complex output signal of the integral monitor waveguide.

Figure 3:
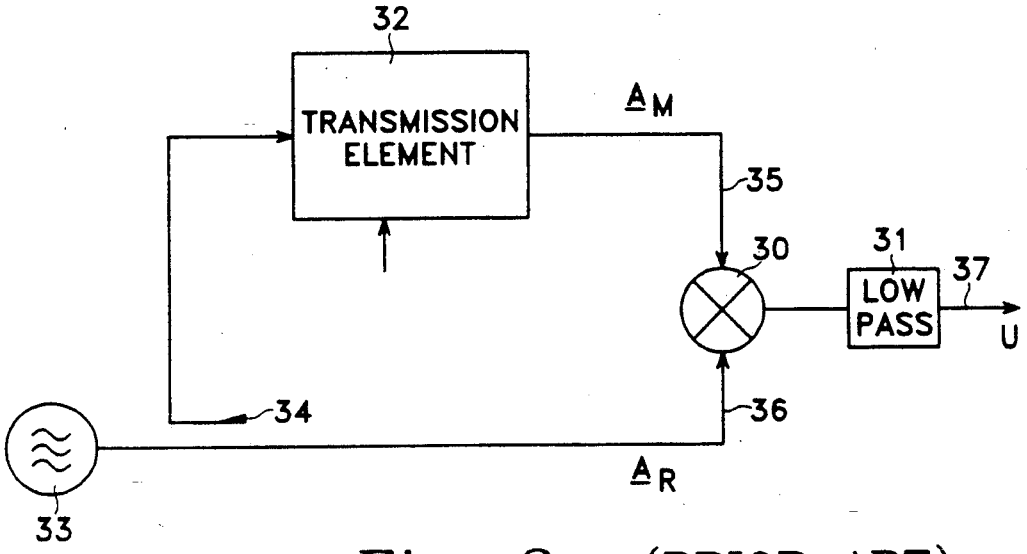
Fig. 3 (PRIOR ART)
FIG. 3 shows the basic design of a homodyne measuring system.

FIG. 3 shows the basic configuration of a homodyne measuring system. A mixer 30 is applied with signals via lines 35 and 36. The output of the mixer 30 is applied to a low-pass filter 31, whose output 37 provides the desired signal. The reference numeral 32 denotes a transmission element whose complex transfer function is to be determined with the arrangement shown. A radio-frequency generator 33 has its output coupled to the mixer 30 via the line 36. The output of the generator 33 is also coupled via a coupler 34 into the transmission element 32. The purpose of the arrangement is to obtain the real part of the complex transfer function of the transmission element 32 at the output 37. Assuming that the amplitude of the signal at the input 35 is substantially smaller than the amplitude of the signal at the input 36, i.e., that the mixer 30 is operating in the linear region, the following results:

A signal $\underline{A}_M$ and a signal $\underline{A}_R$ are applied to the mixer 30 over the lines 35 and 36, respectively. The voltage U at the output 37 is $$U \sim |\underline{A}_M(t)|\cos(\psi_M - \psi_R)$$
$$\sim |\underline{A}_M(t)|\cos(\Delta\alpha + \psi(t))$$

where $\psi_M = \omega_O t + \alpha_M + \phi(t)$ = phase of the monitor signal $\psi_R = \omega_O t + \alpha_R$ = phase of the reference signal $\phi(t)$ = general phase function of system 32

$\Delta\alpha = \alpha_M - \alpha_R$.

As mentioned above, the real part of the complex transfer function of the transmission element 32 is available at the output 37.

The real and imaginary parts of the spectrum of complex, causal time functions are related by an integral transform, the so-called Hilbert transform. Consequently, it suffices to measure the real part of such functions, since the imaginary part can be computed by way of the Hilbert transform.

Figure 4:
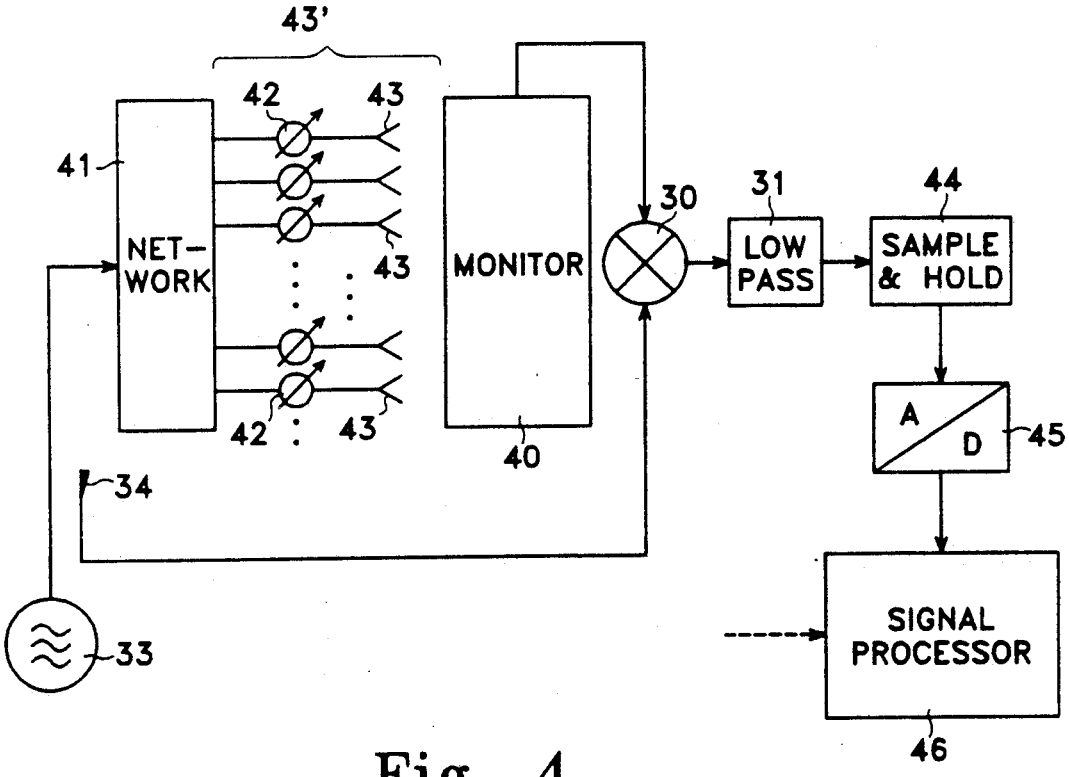
FIG. 4 shows a monitoring facility for a phased-array antenna.

FIG. 4 shows an antenna of a microwave landing system (MLS) which uses the homodyne measuring method of FIG. 3 to obtain the antenna aperture illumination. Like reference characters have been used to designate like elements. As in FIG. 3, a mixer 30, a low-pass filter 31, a radio-frequency-signal source 33, and a coupler 34 are provided. The element 40 is a monitor implemented, for example, as an integral monitor waveguide, like element 10 in FIG. 1. A network 41 distributes the electric energy from the radio-frequency source 33 via phase shifters 42 to radiating elements 43 of the array antenna. 43' denotes the entirety of the radiating elements and phase shifters. From the radiating elements, signals are coupled to the integral monitor waveguide 40. The output of the integral monitor waveguide is fed to the mixer 30, which is also supplied with the radio-frequency signal via the coupler 34. At the output of the low-pass filter 31 the voltage U described in connection with FIG. 3 is available. This voltage U is the real part of the output signal of the integral monitor waveguide 40. The voltage U developed at the output of the low-pass filter 31 is digitized by means of a sample-and-hold circuit 44 and an analog-to-digital converter 45. A time- and value-discrete signal is thus available at the output of the analog-to-digital converter 45. From this time- and value-discrete signal, the imaginary part of the output signal of the integral monitor waveguide 40 is computed via the discrete Hilbert transform with the aid of a signal processor 46. After this operation, the complete complex far-field signal of the phased-array antenna is available. Use of the discrete Fourier transform (DFT) or the fast Fourier transform (FFT) then provides the inverse transform of the antenna aperture illumination.

Regarding the implementation of the discrete Hilbert transform of the discrete Fourier transform and the fast Fourier transform, the person skilled in the signal-processing art is referred to a wealth of literature on this subject, such as an article entitled "Quadrature Sampling with High Dynamic Range", IEEE Transactions on Aerospace and Electronic Systems, Vol. AES-18, No. 4, November 1982, pages 736 to 739.

Figure 5:
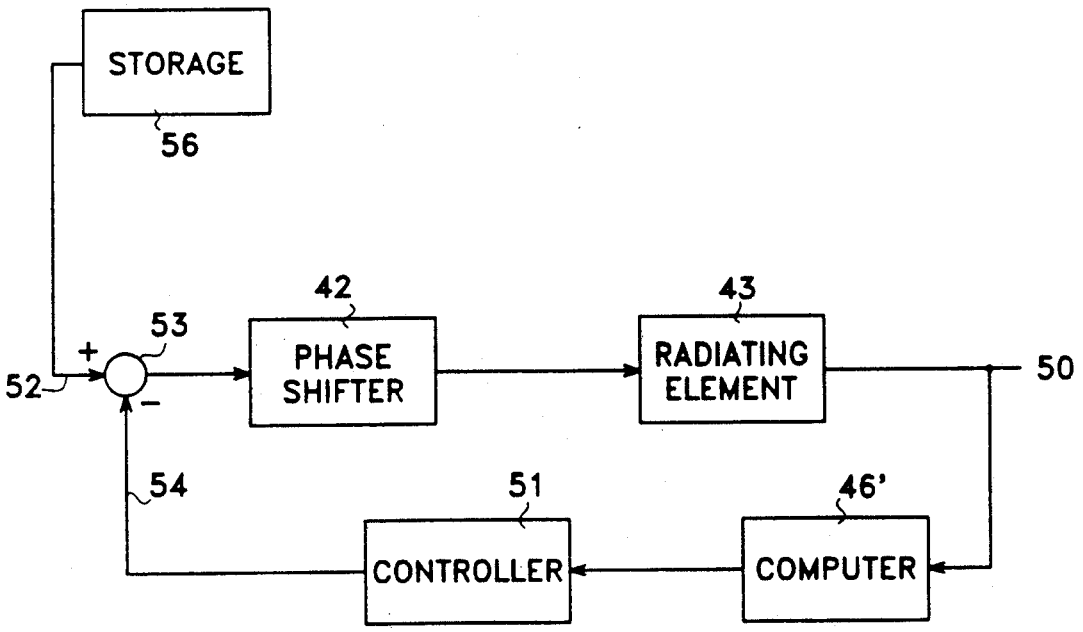
FIG. 5 shows an automatic control system for calibrating a phased-array antenna.

FIG. 5 shows in more detail how the phase-array antenna of FIG. 4 is calibrated. Like reference characters are used to designate like elements. The phase-array antenna with its radiating elements 43 is shown in FIG. 5 as a block 43. The phase shifters appear as a block 42. A signal 50 appearing at the output of the integral monitor waveguide 40 corresponds to the far field of the antenna. In a computing unit 46', this signal 50 is subjected to an integral transformation to obtain the aperture illumination of the antenna. The output of the computing device 46' is fed to a controller 51. Via a line 52 from storage means 56, the desired value for the phase setting of the phase shifter 42 is fed to a summing point 53. The output signal from the controller 51, which is fed to the summing point 53 via a line 54, is subtracted from this desired value. The phase shifter is thus supplied with the difference between the desired value on line 52 and the output signal from the controller 51 on line 54. The computing device 46', the controller 51, the summing point 53, and the line carrying the desired values 52 may be implemented in software in a signal processor. All the steps necessary to carry out the method may be performed, for example, in the signal processor 46 of FIG. 4. From FIG. 5 it is apparent that an automatic control system as shown in FIG. 5 is associated with each radiating element 43 of the phased-array antenna. To calibrate the antenna, in a first step, a comparison between the desired value and the actual value of the aperture illumination is performed. At the same time, correction values are generated by the controller. If complete agreement between desired and actual values should not be attainable with these correction values, the control parameters are changed (adaptive control system) and the process just described is repeated. The process is repeated until the desired and actual values of the aperture illumination differ only within prescribed tolerance bands. During the process, the sampling rate of the monitor signal must be so high that immediate aliasing effects in the reconstructed illumination function become negligibly small, i.e., clearly above the Nyquist rate.

The aperture illumination is determined using a Hilbert transform of the output of an integral monitor waveguide.

I claim:

1. Method of calibrating an array antenna comprising a plurality of radiating elements which cooperate to produce an operational transmission having an associated far field pattern and an associated aperture illumination, and an integral monitor waveguide responsive to the combined ouput of all of said radiating elements during said operational transmission, wherein:

first signals corresponding to the far field pattern of the array antenna are derived from an output of the integral monitor waveguide during said operational transmission, second signals corresponding to the aperture illumination of the antenna are derived from the first signals using an integral transform, the second signals are compared with third signals stored in storage means, a difference signal corresponding to the deviation of the second signals from the third signals is produced which is fed to a controller whose output acts on phase shifters connected to the array antenna, and the foregoing steps are repeated until the difference signal lies within a predetermined tolerance band.

2. A method as claimed in claim 1, wherein the first, second, and third signals are discrete-time signals.

3. A method as claimed in claim 2, wherein the said integral transform is a fast Fourier transform.

4. A method as claimed in claim 2, wherein the controller is a microprocessor.

5. A method as claimed in claim 2, wherein the controller is a computer.

6. A method as claimed in claim 1, wherein said array antenna is part of a microwave landing system.

7. Apparatus for calibrating a phased-array antenna having a plurality of radiating elements supplied with radio-frequency energy via electronically controlled phase shifters, the apparatus comprising an integral monitor waveguide responsive to the outputs of said radiating elements for producing a combined output signal corresponding to the far field pattern of the antenna, first means for using a Fourier transform to convert the combined output signal of the integral monitor waveguide into an aperture illumination of the array antenna, storage means for storing a desired aperture illumination, comparing means for determining the deviation between the desired aperture illumination stored by the storage means and the aperture illumination of the array antenna determined by the first means, and control means for controlling each of the electronic phase shifters as a function of the deviation determined by the comparing means.

8. An apparatus as claimed in claim 7, wherein the control means and the comparing means -single microprocessor functioning as part of both the control means and the comparing means.

9. An apparatus as claimed in claim 7, wherein the control means and the comparing means further comprise a single computer functioning as part of both the control means and the comparing means.

10. An apparatus as claimed in claim 7, wherein said phased-array antenna is part of a microwave landing system.

11. Method of determining a complex aperture illumination of a phased-array antenna having a plurality of radiating elements, said method comprising the steps:

a) using a Fourier transform to derive a time-varying complex signal from an output from an integral monitor waveguide responsive to the combined output of said radiating elements, b) using homodyne detection apparatus to detect the real part of the complex signal, and c) using a Hilbert transform to compute the imaginary part of the complex signal.

12. A method as claimed in claim 11, wherein said Hilbert transform is a discrete Hilbert transform.

13. A method as claimed in claim 12, wherein said Fourier transform is a discrete Fourier transform and further comprises homodyne detection means to detect the real part of the complex signal, and Hilbert transform means to compute the imaginary part of the complex signal.

14. Apparatus for determining a complex aperture illumination of a phased-array antenna having a plurality of radiating elements for producing a radiation pattern, said apparatus comprising an integral monitor waveguide whose output provides a complex, time-varying first signal having real and imaginary parts each corresponding to said radiation pattern, a source of radio-frequency energy having a carrier frequency $f_0$, a network for distributing the radio-frequency energy to the radiating elements to produce said radiation pattern, a single mixer directly coupled to the output of the integral monitor waveguide for multiplying the first signal by a time-invariant second signal having a frequency equal to said carrier frequency $f_0$ to thereby produce a time-varying third signal corresponding to the real part of said first signal, and a low-pass filter coupled to an output of said single mixer for passing only a low frequency component of said third signal.

15. An apparatus as claimed in claim 14, further comprising an analog-to-digital converter for digitizing the output of the low-pass filter.

16. An apparatus as claimed in claim 15, further comprising a signal processor for subjecting the output of the analog-to-digital converter to a Hilbert transform.

* * * * *